US011198989B2

(12) United States Patent
Fukuda et al.

(10) Patent No.: US 11,198,989 B2
(45) Date of Patent: Dec. 14, 2021

(54) HYDRAULIC SYSTEM FOR WORKING MACHINE

(71) Applicant: KUBOTA CORPORATION, Osaka (JP)

(72) Inventors: Yuji Fukuda, Osaka (JP); Hiroaki Nakagawa, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 17/030,739

(22) Filed: Sep. 24, 2020

(65) Prior Publication Data

US 2021/0095443 A1 Apr. 1, 2021

(30) Foreign Application Priority Data

Oct. 1, 2019 (JP) ..... JP2019-181537

(51) Int. Cl.
*E02F 9/22* (2006.01)

(52) U.S. Cl.
CPC ..... *E02F 9/2296* (2013.01); *E02F 9/2225* (2013.01); *E02F 9/2232* (2013.01); *E02F 9/2267* (2013.01); *E02F 9/2285* (2013.01)

(58) Field of Classification Search
CPC ..... E02F 9/2267; F15B 2211/3056; F15B 2211/30565; F15B 2211/31529
See application file for complete search history.

(56) References Cited

U.S. PATENT DOCUMENTS 6,971,453 B2 * 12/2005 Nordhoff ..... A01B 63/1006 172/439
7,353,885 B2 * 4/2008 Nordhoff ..... A01B 59/068 172/272
7,441,407 B2 * 10/2008 Sawada ..... E02F 9/2225 60/431
8,573,111 B2 * 11/2013 Graham ..... A01C 7/205 91/447
9,803,748 B2 * 10/2017 Hendrix ..... F15B 1/024

FOREIGN PATENT DOCUMENTS

DE 102017219942 A1 * 5/2019 ..... F15B 11/10
JP 2018-200103 A 12/2018

* cited by examiner

*Primary Examiner* — Thomas E Lazo
(74) *Attorney, Agent, or Firm* — Greenblum & Bernstein, P.L.C.

(57) ABSTRACT

A hydraulic system for a working machine includes a hydraulic pump to output operation fluid, a hydraulic actuator to be activated with the operation fluid, a first control valve to which the operation fluid outputted by the hydraulic pump is supplied, the first control valve being configured to control the hydraulic actuator, a second control valve to control the hydraulic actuator separately from the first control valve, a first fluid tube connecting the hydraulic pump and the first control valve, a second fluid tube branching from the first fluid tube and connecting to an input port of the second control valve, a third fluid tube connecting the first control valve and the hydraulic actuator, and a fourth fluid tube connecting to an output port of the second control valve and connecting to the third fluid tube.

11 Claims, 9 Drawing Sheets

HYDRAULIC SYSTEM FOR WORKING MACHINE

CROSS-REFERENCE TO RELATED APPLICATIONS

The present application claims priority under 35 U.S.C. § 119 to Japanese Patent Application No. P2019-181537, filed Oct. 1, 2019. The content of this application is incorporated herein by reference in their entirety.

BACKGROUND OF THE INVENTION

Field of the Invention

The present invention relates to a hydraulic system for a working machine such as a skid steer loader and a compact track loader.

Description of Related Art

Conventionally, Japanese Patent Application Publication No. 2018-200103 discloses a technique for increasing the capacity of hydraulic fluid supplied to a hydraulic actuator with respect to working machines such as a skid steer loader and a compact track loader.

The working machine disclosed in Japanese Patent Application Publication No. 2018-200103 includes a hydraulic actuator, a connector portion connecting the hydraulic actuator, a first hydraulic pump including a fixed displacement pump to discharge hydraulic fluid, a second hydraulic pump including a fixed displacement pump to discharge the hydraulic fluid separately from the first hydraulic pump, a first fluid tube connecting the connector portion to the first hydraulic pump, a second fluid tube connecting the second hydraulic pump to the first fluid tube, and a control valve provided to the second fluid tube and configured to set a flow rate of hydraulic fluid flowing in the second fluid tube.

SUMMARY OF THE INVENTION

A hydraulic system for a working machine includes a hydraulic pump to output operation fluid, a hydraulic actuator to be activated with the operation fluid, a first control valve to which the operation fluid outputted by the hydraulic pump is supplied, the first control valve being configured to control the hydraulic actuator, a second control valve to control the hydraulic actuator separately from the first control valve, a first fluid tube connecting the hydraulic pump and the first control valve, a second fluid tube branching from the first fluid tube and connecting to an input port of the second control valve, a third fluid tube connecting the first control valve and the hydraulic actuator, and a fourth fluid tube connecting to an output port of the second control valve and connecting to the third fluid tube.

DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
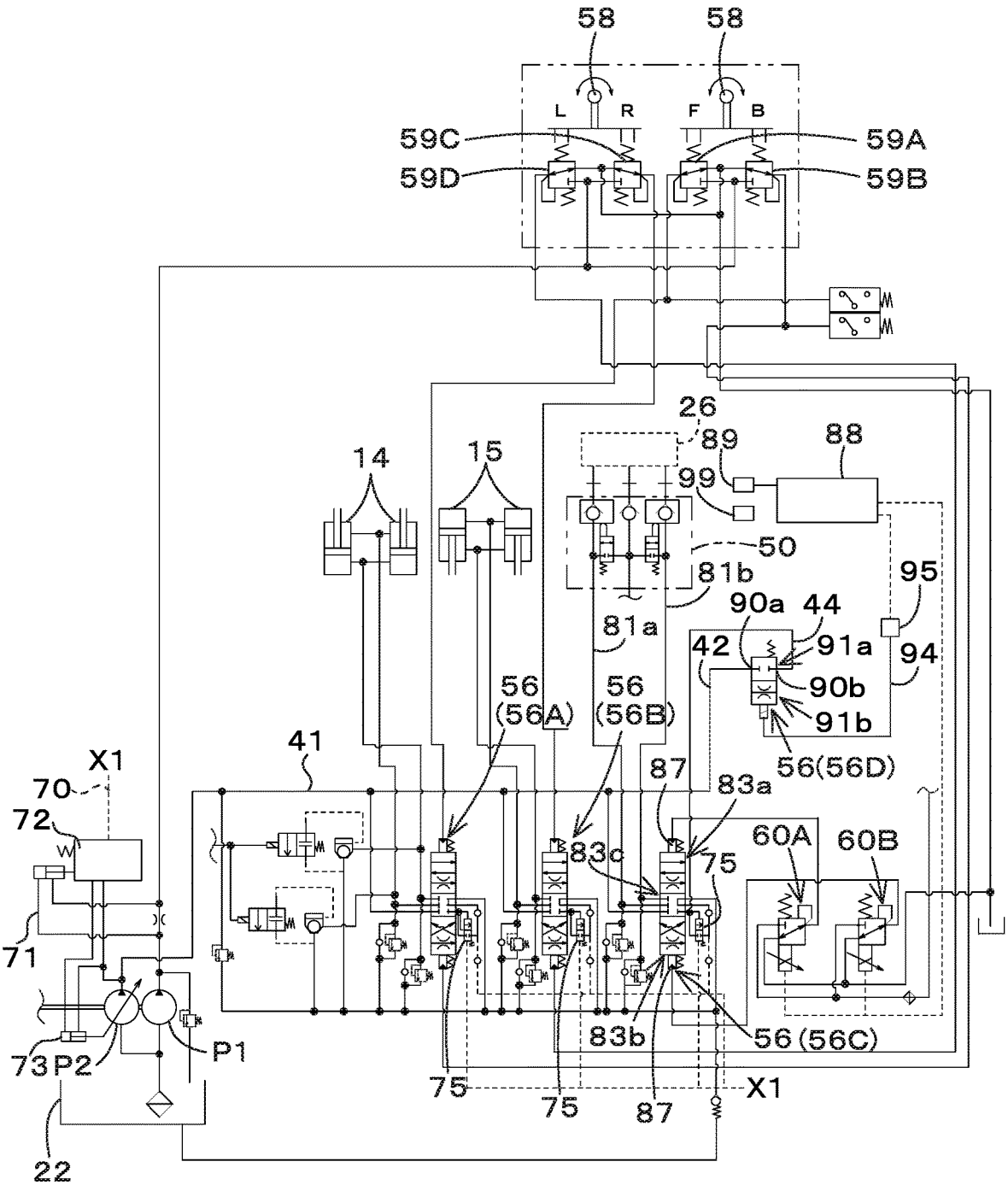
FIG. 1 is a schematic view of a hydraulic system for working according to embodiments of the present invention.

The embodiments of the present invention will now be described with reference to the accompanying drawings, wherein like reference numerals designate corresponding or identical elements throughout the various drawings. The drawings are to be viewed in an orientation in which the reference numerals are viewed correctly.

First Embodiment

Figure 5:
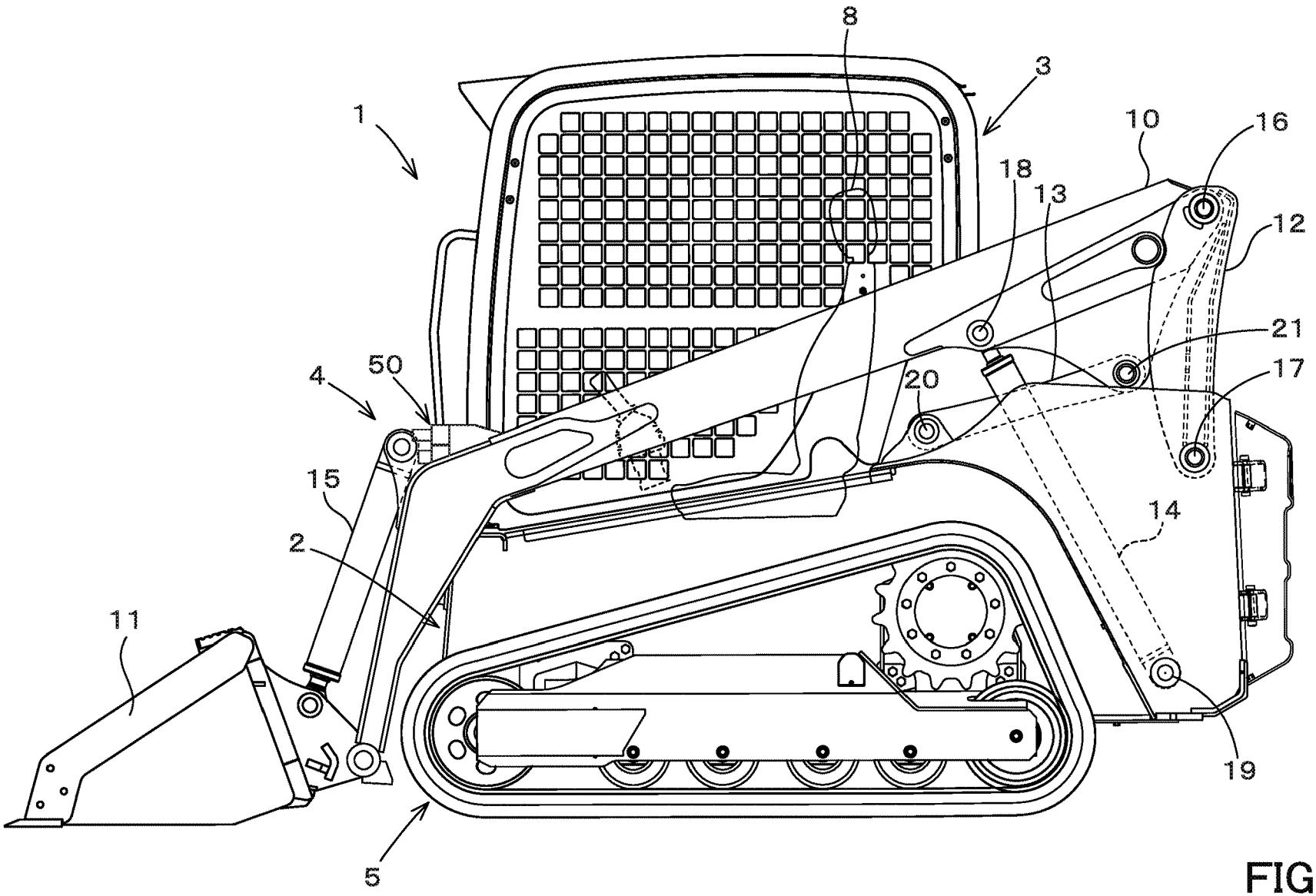
FIG. 5 is a side view of a track loader that is an example of a working machine according to the embodiments.

First, the overall configuration of the working machine will be described below. As shown in FIG. 5, the working machine 1 is provided with an machine body 2, a cabin 3, a working device 4, and a traveling device 5. FIG. 5 shows a compact track loader as an example of a working machine. However, the working machine of the present invention is not limited to the compact track loader. For example, the working machine of the present invention may be a tractor, a skid steer loader, a backhoe, and the like.

In the explanation of the present invention, the front side (left side of FIG. 5) of an operator seated in an operator seat 8 of the working machine is referred to as the front, and the rear side (right side of FIG. 5) of the operator is referred to as the rear. In addition, the left side of the operator (the front surface side of FIG. 5) is referred to as the left, and the right side of the operator (the back surface side of FIG. 5) is referred to as the right.

Cabin 3 is mounted on machine body 2. The cabin 3 is provided with the operator seat 8. The working machine 4 is mounted on the machine body 2. A travelling device 5 is provided on the outside of the machine body 2. A motor is mounted on the rear portion of the machine body 2.

The working machine 4 has booms 10, a working tool 11, lift links 12, control links 13, boom cylinders 14, and bucket cylinders 15.

The booms 10 are pivoted up and down on the right and left sides of the cabin 3. The working tool 11 is, for example, a bucket. The bucket 11 is provided at the end portion (front end portion) of the boom 10 with the ability to be swung up and down.

The lift link 12 and control link 13 support the base portion (rear portion) of the boom 10. This allows the boom 10 to pivot up and down freely. The boom cylinder 14 extends and shortens to raise and lower the boom 10. The bucket cylinder 15 extends and shortens to pivot the bucket 11.

The front portions of the booms 10 on the left and right side are connected to each other by a deformed connecting pipe. The base portions (rear portions) of each booms 10 are connected to each other by a circular connecting pipe.

A combination of the lift link 12, control link 13 and boom cylinder 14 is provided on the left side of the machine body 2, corresponding to the boom 10 on the left side. Another combination of the lift link 12, control link 13 and boom cylinder 14 is provided on the right side of the machine body 2, corresponding to the boom 10 on the right side.

A lift link 12 is provided vertically at the rear portion of the base of each boom 10. The upper portion (one end side) of the lift link 12 is pivoted freely around the lateral axis by a pivot shaft 16 (first pivot shaft) near the rear portion of the base of each boom 10.

The lower portion (the other end side) of the lift link 12 is pivoted freely around a lateral axis by a pivot shaft 17 (the second pivot shaft) near the rear of the body 2. The second pivot shaft 17 is provided below the first pivot shaft 16.

The upper portion of the boom cylinder 14 is pivoted freely around a lateral axis by a pivot shaft 18 (third pivot shaft). The third pivot shaft 18 is arranged at the base portion of each boom 10 and is arranged at the front portion of the base portion.

The lower portion of the boom cylinder 14 is pivoted freely around a lateral axis via a pivot shaft 19 (fourth pivot shaft). The fourth pivot shaft 19 is arranged near the bottom of the rear of the machine body 2 and is arranged below the third pivot shaft 18.

A control link 13 is provided in front of the lift link 12. One end of the control link 13 is rotatably pivoted around a lateral axis by a pivot shaft 20 (fifth pivot shaft). The fifth pivot shaft 20 is provided on the machine body 2 and is arranged correspondingly forward of the lift link 12.

The other end of the control link 13 is rotatably pivoted around a lateral axis by a pivot shaft 21 (sixth pivot shaft). The sixth pivot axis 21 is provided on the boom 10 and is arranged in front of and above the second pivot axis 17.

When the boom cylinder 14 is extended or shortened, each boom 10 is pivoted up and down around the first pivot axis 16 while the base of each boom 10 is supported by the lift link 12 and the control link 13. This raises and lowers the tip portion of each boom 10.

The control link 13 pivots up and down around the fifth pivot axis 20 with the vertical oscillation of each boom 10. The lift link 12 pivots back and forth around the second pivot axis 17 in accordance with the vertical oscillation of the control link 13.

The front portion of the boom 10 can be attached with another work tool in place of the bucket 11. The other working machine is, for example, a hydraulic crusher, hydraulic breaker, angle broom, earth auger, pallet fork, sweeper, mower, snow blower and other attachments (auxiliary attachments).

A connector member 50 is provided at the front portion of the boom 10 on the left side. The connector member 50 is a device configured to connect the hydraulic device on the auxiliary attachment to a pipe or other first pipe member on the boom 10.

In particular, a first tube member can be connected to one end of the connector member 50. A second tube member connected to the hydraulic device of the auxiliary attachment can be connected to the other end of the connector member 50. As a result, the hydraulic fluid flowing through the first tube member passes through the second tube member and is supplied to the hydraulic device.

The bucket cylinders 15 are arranged near the front of each boom 10, respectively. The bucket 11 is pivoted by the stretching and shortening of the bucket cylinders 15. The traveling devices 5 on the left and right sides are of the crawler type (including the semi-crawler type) in this embodiment. A wheel-type traveling device having a front wheel and a rear wheel may be employed.

As shown in FIG. 1, the hydraulic system for the working machine is provided with a first hydraulic pump P1, a second hydraulic pump P2, a plurality of control valves 56, and a plurality of pressure compensation valves 75.

The first hydraulic pump P1 is configured to output hydraulic fluid stored in the hydraulic fluid tank 22. In particular, the first hydraulic pump P1 outputs hydraulic fluid that is primarily used for control. The second hydraulic pump P2 is a variable displacement pump installed at a position different from the first hydraulic pump P1. The second hydraulic pump P2 is configured to output hydraulic fluid stored in the hydraulic fluid tank 22.

Of the hydraulic fluid outputted from the hydraulic pump 1 P1, the hydraulic fluid used for control is called the pilot fluid, and the pressure of the pilot fluid is sometimes referred to as the pilot pressure.

On the output side of the first hydraulic pump P1, an output fluid tube (first fluid tube) 41 is provided for flowing hydraulic fluid (the pilot fluid). A plurality of control valves 56 are connected to the output fluid tube (first fluid tube) 41.

The plurality of control valves 56 are control valves configured to control the hydraulic actuators. The plurality of control valves 56 control, for example, one of the hydraulic actuators, such as the boom cylinder 14 and the bucket cylinder 15. The plurality of control valves 56 include a boom control valve 56A and a bucket control valve 56B.

The boom control valve 56A is a valve configured to control the boom cylinder 14. A bucket control valve 56B is a valve configured to control a bucket cylinder 15. The boom control valve 56A and the bucket control valve 56B are pilot-type three-position switching valves of direct-acting spool-type, respectively.

The boom control valve 56A and the bucket control valve 56B are switched between a neutral position, a first position, and a second position in accordance with the pilot pressure.

A boom cylinder 14 is connected to the boom control valve 56A by a fluid tube. A bucket cylinder 15 is connected to the bucket control valve 56B by the fluid tube.

The boom 10 and bucket 11 can be operated by an operation lever 58 provided around the operator seat 8. The operation lever 58 is supported to be tilted back and forth, left and right, and diagonally from the neutral position. When the operation lever 58 it tilted, each pilot valve provided at the bottom of the operation lever 58 can be operated.

When the operation lever 58 is tilted forward, the pilot valve 59A for lowering is operated, and the lowering pilot valve 59A outputs a pilot pressure. This pilot pressure acts on the pressure receiver portion of the boom control valve 56A, and thereby the boom 10 is lowered.

When the operation lever 58 is tilted backward, the pilot valve 59B for rising is operated, and the rising pilot valve 59B outputs a pilot pressure. This pilot pressure acts on the pressure receiver portion of the boom control valve 56A, and thereby the boom 10 is raised.

When the operation lever 58 is tilted to the right, the pilot valve 59C for bucket dumping is operated, and the pilot fluid acts on the receiving portion of the bucket control valve 56B. As a result, the bucket control valve 56B operates in the direction of extending the bucket cylinder 15, and the bucket 11 dumps the bucket 11 at a speed proportional to the amount of the tilting of the operation lever 58.

When the operation lever 58 is tilted to the left, the pilot valve 59D for bucket scooping is operated, and the pilot fluid acts on the receiving portion of the bucket control valve 56B. As a result, the bucket control valve 56B operates in the direction of reshortening the bucket cylinder 15, and the bucket 11 performs the scooping movement at a speed proportional to the amount of the tilting of the operation lever 58.

Now, the hydraulic system for the working machine is capable of controlling one hydraulic actuator with a plurality of control valves 56. In particular, the plurality of control valves 56 include a first auxiliary control valve 56C and a second auxiliary control valve 56D, in addition to the boom control valve 56A and the bucket control valve 56B.

The first auxiliary control valve 56C and the second auxiliary control valve 56D are capable of controlling one hydraulic actuator 26 on the auxiliary attachment. The hydraulic actuator 26 is a hydraulic cylinder, a hydraulic motor, a hydraulic pump, and the like. For convenience of explanation, the first auxiliary control valve 56C is referred to as the "first control valve 56C", and the second auxiliary control valve 56D is referred to as the "second control valve 56D".

The hydraulic system for the working machine is provided with a load sensing system. The load sensing system controls the second hydraulic pump P2 so that the differential pressure between the maximum load pressure and the discharge pressure of the second hydraulic pump P2 can be constant at the time of operation of the hydraulic actuator (the system controls the outputting rate of the second hydraulic pump P2). The load sensing system has a PLS fluid tube 70 with a plurality of control valves 56 connected, a PPS fluid tube 71, a regulator 72, and a tilting piston 73.

Of the plurality of control valves 56, the pressure with the highest load pressure (PLS signal pressure) acts on the PLS fluid tube 70, while the PPS fluid tube 71 is transmitted to the regulator 72. The regulator 72 actuates the tilting piston 73 to make the differential pressure (PPS signal pressure–PLS signal pressure) between the PPS signal pressure and the PLS signal pressure, which is the discharge pressure of the hydraulic fluid of the second hydraulic pump P2, constant.

Figure 2:
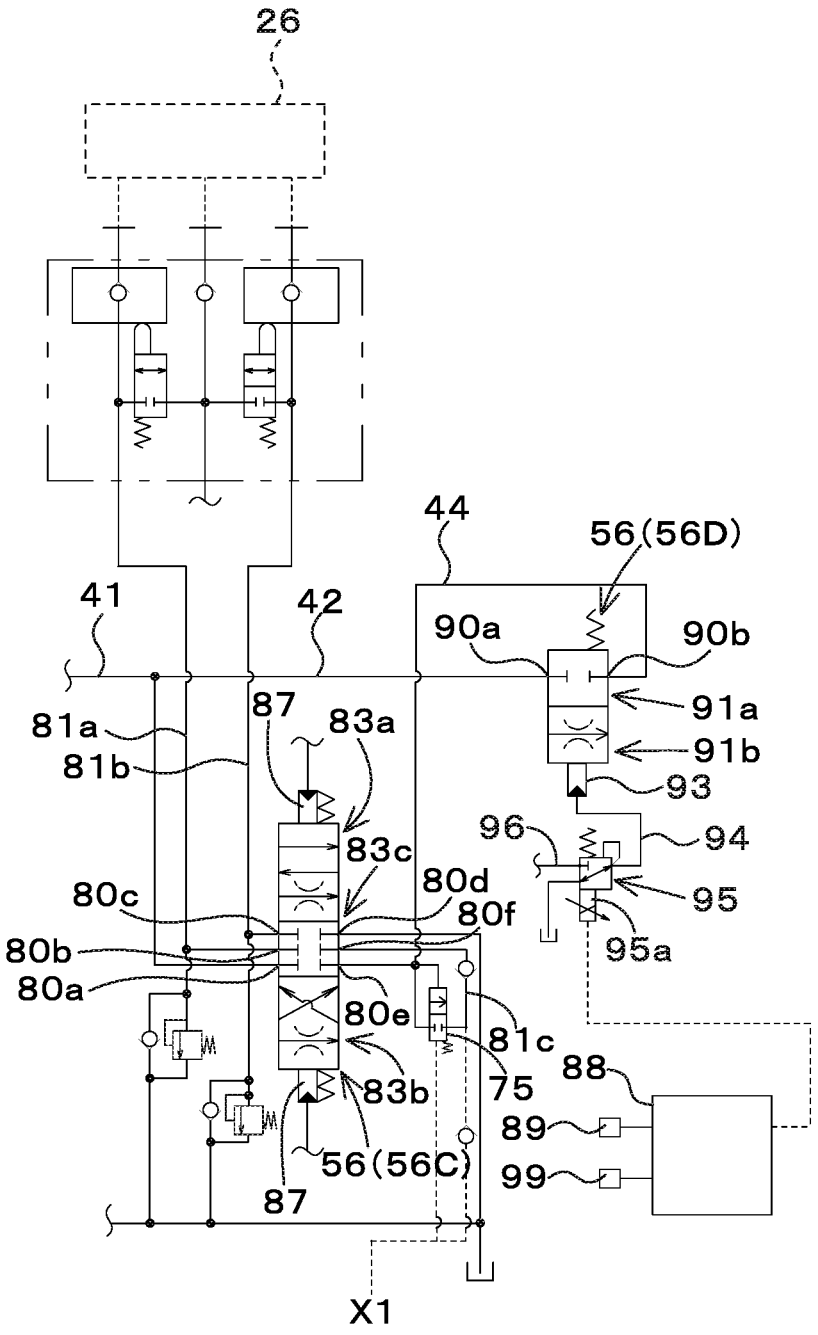
FIG. 2 is an enlargement view of a first control valve and a second control valve according to the embodiments.

As shown in FIG. 2, the first control valve 56C has an input port 80*a*, output ports 80*b* and 80*c*, an output port 80*d*, and circulation ports 80*e* and 80*f*. An output fluid tube (first fluid tube) 41 is connected to the input port 80*a*, and the hydraulic fluid outputted from the second hydraulic pump P2 is introduced to the input port 80*a*. Supplying-discharging fluid tubes 81*a* and 81*b* are connected to the output ports 80*b* and 80*c*. The circulation ports 80*e* and 80*f* are connected to the circulation ports 80*e* and 80*f* by the supplying-discharging fluid tube 81*c*.

The hydraulic fluid introduced into the input port 80*a* of the first control valve 56C passes through the circulation ports 80*e* and 80*f* and the supplying-discharging fluid tubes 81*c* and flows into the supplying-discharging fluid tubes 81*a* and 81*b*. That is, the supplying-discharging fluid tubes 81*a*, 81*b*, and 81*c* are third fluid tubes connecting the first control valve 56C and the hydraulic actuator 26.

The first control valve 56C is a pilot-type three-position switching valve of direct-acting spool-type, which switches between the neutral position 83*c*, the first position 83*a*, and the second position 83*b*. When the first control valve 56C is in the neutral position 83*c*, no hydraulic fluid flows from the output ports 80*b* and 80*c* to the third fluid tubes 81*a* and 81*b* because the input port 80*a* is not in communication with the circulation ports 80*e* and 80*f*. That is, when the first control valve 56C is in the neutral position 83*c*, no hydraulic fluid is supplied to the hydraulic actuator 26.

When the first control valve 56C is in the first position 83*a*, the input port 80*a* is connected to the circulation port 80*e*, and the circulation port 80*f* is connected to the output port 80*b*. As a result, the hydraulic fluid is supplied from the output port 80*b* to the supplying-discharging fluid tube (third fluid tube) 81*a*. That is, the first control valve 56C supplies the hydraulic fluid to the hydraulic actuator 26 in the first position 83*a*, which is the supply position.

When the first control valve 56C is in the second position 83*b*, the input port 80A is connected to the circulation port 80E, and the circulation port 80F is connected to the output port 80C. As a result, the hydraulic fluid is supplied from the output port 80*c* to the supplying-discharging fluid tube (third fluid tube) 81*b*. That is, the first control valve 56C supplies the hydraulic fluid to the hydraulic actuator 26 even in the second position 83*b*, which is the supply position.

As shown in FIG. 1, the first control valve 56C is operated by the first proportional valve 60A and the second proportional valve 60B. The first proportional valve 60A and the second proportional valve 60B are set to have a aperture of opening by the controller device 88. In particular, an operation member 89 such as a switch or the like is connected to the controller device 88. The controller device 88 sets the opening apertures of the first proportional valve 60A and the second proportional valve 60B based on the amount of operation of the operation member 89.

As a result, the pilot pressure of either the first proportional valve 60A or the second proportional valve 60B acts on the pressure receiver portion 87 of the first control valve 56C. This allows the hydraulic actuator 26 to be operated.

As shown in FIG. 2, the second control valve 56D has an input port 90*a* and an output port 90*b*. A second fluid tube 42 is connected to the input port 80*a*. The second fluid tube 42 is a fluid tube branched from the output fluid tube (first fluid tube) 41. The hydraulic fluid outputted from the second hydraulic pump P2 is introduced into the second fluid tube 42. A fourth fluid tube 44 is connected to the output port 90*b*. The fourth fluid tube 44 is connected to (and merges with) one of the third fluid tubes, supplying-discharging fluid tube 81*c*.

The second control valve 56D is a pilot-type two-position switching valve of direct-acting spool-type, which switches between the first position 91*a* and the second position 91*b*. When the second control valve 56D is in the first position 91*a*, the input port 90*a* and the output port 90*b* are shut off. That is, since the second control valve 56D is in a closing state, no hydraulic fluid is supplied from the output port 90*b* to the fourth fluid tube 44.

When the second control valve 56D is in the second position 91*b*, the input port 90*a* and the output port 90*b* are in continuity with the input port 90*a* and the output port 90*b*, so that the hydraulic fluid is supplied from the output port 90*b* to the fourth fluid tube 44.

The second control valve 56D is provided with a pressure receiver portion 93 configured to receive the pilot fluid. When the pilot pressure acting on the pressure receiver portion 93 is less than a predetermined pressure (less than the switching pressure), the second control valve 56D is in the first position 91*a* and thus is in a closing state. On the other hand, when the pilot pressure acting on the pressure receiver portion 93 is the predetermined pressure or higher (the switching pressure or higher), the second control valve 56D gradually switches from the first position 91*a* to the second position 91*b*. This causes the second control valve 56D to change from the closing state to the opening state.

That is, the second control valve 56D is opened to a greater aperture as the pilot pressure acting on the pressure receiver portion 93 increases. The setting of the pilot pressure to the pressure receiver portion 93 is set by a proportional valve 95 connected via the fluid tube 94. A pilot fluid tube 96 is connected to the proportional valve 95. This supplies the pilot fluid outputted from the second hydraulic pump P2 to the pilot fluid tube 96.

The aperture of opening of the proportional valve 95 is set by the controller 88. For example, when the opening aperture of the first control valve 56C is greater than or equal to the predetermined aperture, that is, when the opening aperture of either the first proportional valve 60A or the second proportional valve 60B operating the first control valve 56C is greater than or equal to the predetermined aperture, the controller device 88 magnetizes the solenoid 95*a* of the proportional valve 95.

When the solenoid 95*a* of the proportional valve 95 is magnetized, the proportional valve 95 transits from a closing state to an opening state. This causes the pilot pressure acting on the pressure receiver portion 93 of the second control valve 56D to increase. In other words, when the proportional valve 95 transits from the closing state to the opening state, the second control valve 56D also transits from the closing state to the opening state.

Figure 3:
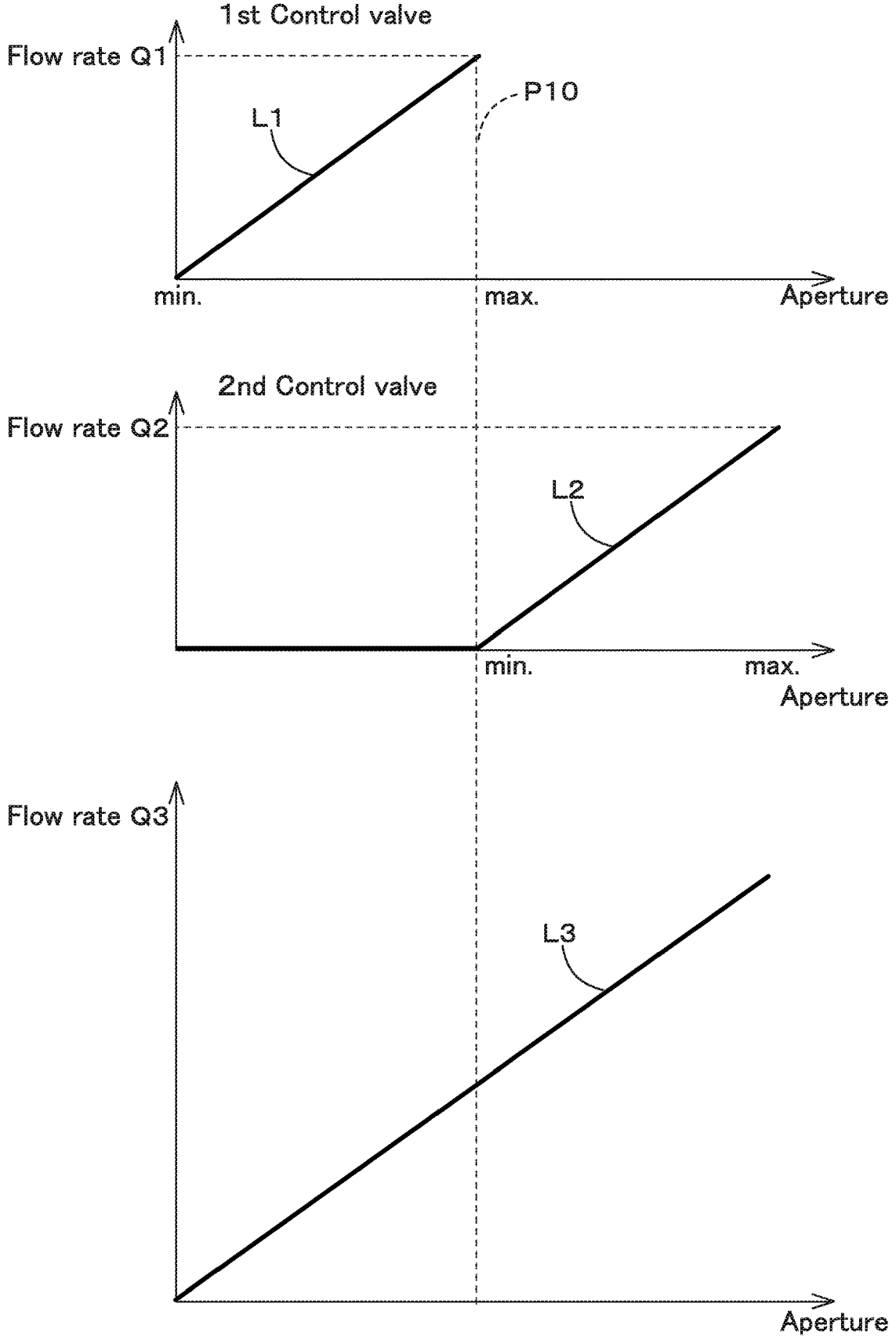
FIG. 3 is a view showing a relation between opening apertures of the first control valve and the second control valve, a flow rate Q1, a flow rate Q2, and a flow rate Q3 according to the embodiments.

FIG. 3 shows the relation between the opening aperture of the first control valve 56C and the flow rate Q1 supplied from the first control valve 56C, the relation between the opening aperture of the second control valve 56D and the flow rate Q2 supplied from the second control valve 56D, and the relation between the opening aperture of the first control valve 56C and the second control valve 56D and the flow rate Q3 of the hydraulic fluid flowing through the supplying-discharging fluid tube 81C (third fluid tube).

In FIG. 3, the minimum and the maximum indicate the respective openings of the first control valve 56C and the second control valve 56D. As shown in FIG. 1, the opening aperture L1 of the first control valve 56C and the opening aperture L2 of the second control valve 56D are set by the controller device 88 by changing the opening aperture of the proportional valve 95.

As shown in FIG. 3, as the opening of the first control valve 56C increases, the flow rate Q1 gradually increases, as shown in line L1. As the opening of the second control valve 56D increases, the flow rate Q2 also increases as shown in line L2.

Here, when the first control valve 56C is in neutral position 83*c* and the opening is zero (the minimum), the second control valve 56D is in first position 91*a* (the closing state) and the opening is zero (the minimum).

Even when the first control valve 56C is switched from the neutral position 83*c* to the first positions (supply positions) 83*a* and 83*b* and the opening of the first control valve 56C is less than the predetermined opening P10, the second control valve 56D is in the first position 91*a* (closing state) and the opening is zero (minimum).

When the second control valve 56D is closed (with zero opening), the hydraulic fluid flowing from the second fluid tube 42 to the second control valve 56D is not supplied from the second control valve 56D to the fourth fluid tube 44. Therefore, when the opening of the first control valve 56C is less than a predetermined opening P10 from zero, the flow rate Q3 of the hydraulic fluid increases in accordance with the opening of the first control valve 56C and is the same as the flow rate Q1.

On the other hand, when the opening of the first control valve 56C is equal to or larger than the predetermined opening P10, the second control valve 56D switches from the first position 91*a* (the closing state) to the second position 91*b* (the opening state), and the flow rate Q2 of the hydraulic fluid increases in accordance with the opening of the second control valve 56D. Thereby, as shown in line L3, the flow rate Q3 also increases in accordance with the opening of the second control valve 56D.

For example, when the first control valve 56C is maximally open and is equal to or larger than the predetermined opening P10 (when the spool of the first control valve 56C is at full stroke), the second control valve 56D switches from the first position 91*a* (the closing state) to the second position 91*b* (the opening state).

When the second control valve 56D is open, the hydraulic fluid flowing from the second fluid tube 42 to the second control valve 56D is supplied from the second control valve 56D to the fourth fluid tube 44, and the hydraulic fluid in the fourth fluid tube 44 is supplied to the supplying-discharging fluid tube 81C. In other words, at the point when the opening of the first control valve 56C reaches the predetermined opening P10 or more, the flow rate Q3 of the hydraulic fluid increases in accordance with the opening of the second control valve 56D.

As described above, according to the first control valve 56C and the second control valve 56D, when the opening of the first control valve 56C is less than the predetermined P10, the flow rate of the hydraulic fluid supplied to the hydraulic actuator 26 can be set on the basis of the opening of the first control valve 56C. When the opening of the first control valve 56C is equal to or larger than the predetermined opening P10, the flow rate of the hydraulic fluid supplied to the hydraulic actuator 26 can be set on the basis of the openings aperture of the first control valve 56C and the second control valve 56D.

Therefore, when a constant flow rate of supply of the hydraulic fluid to the hydraulic actuator 26 is sufficient, the hydraulic actuator 26 can be activated by operating the first control valve 56C.

On the other hand, when the supply of hydraulic fluid to the hydraulic actuator 26 is greater than the constant flow rate, the hydraulic actuator 26 can be operated, for example, by adjusting the opening of the second control valve 56D with the spool of the first control valve 56C at full stroke.

As shown in FIG. 1, the controller device 88 is connected to the controller device 88 with a switch 99 configured to be switched between ON and OFF. When the switch 99 is ON and in the mode of flowing high flow rate, the opening of the first control valve 56C is changed in accordance with the amount of operation of the operation member 89 if the amount of operation of the operation member 89 is less than the predetermined switching amount.

When the amount of operation of the operation member 89 is equal to or larger than the switching amount, the opening of the first control valve 56C is maximized and the opening of the second control valve 56D is increased in accordance with the amount of operation of the operation member 89. For example, when the amount of operation of the operation member 89 is equal to or larger than the switching amount, the opening aperture of the second control valve 56 is increased in accordance with the amount of operation of the operation member 89.

Figure 4A:
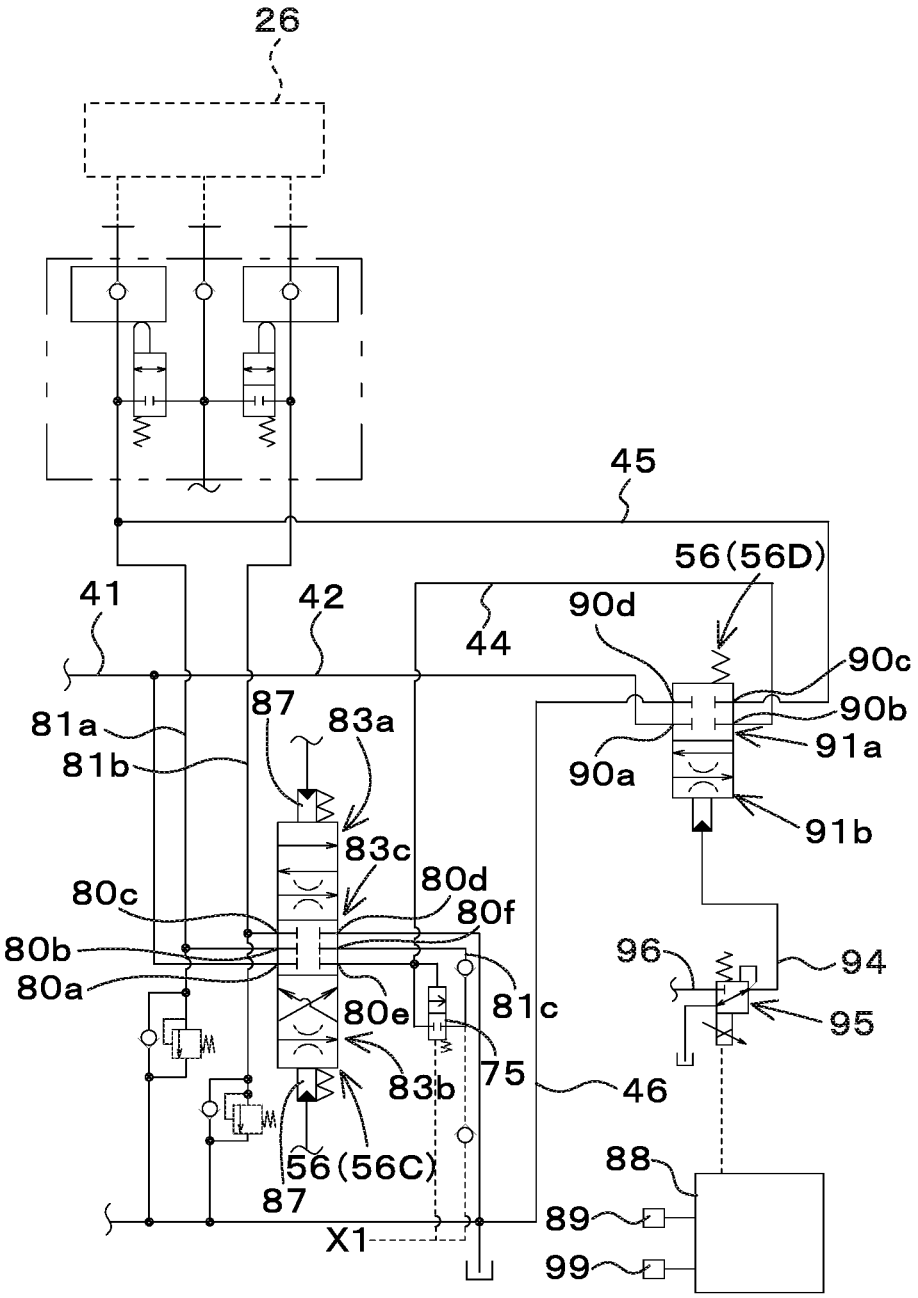
FIG. 4A is a view of a first modified example according to the embodiments.

FIG. 4A shows a first modified example of the hydraulic system of the working machine. The first modified example is an example of a modified second control valve 56D. The second control valve 56D has discharge ports 90*c* and 90*d*.

One end of the output fluid tube 45 is connected to the discharge port 90*c*, and the other end of the output fluid tube 45 is connected to the supplying-discharging fluid tube 81*a*. The discharge port 90*d* is connected to the discharge fluid tube 46. When the second control valve 56D is in the first position 91*a*, the input port 90*a* and the output port 90*b* are shut off.

When the second control valve 56D is in the second position 91*b*, the discharge ports 90*c* and 90*d* are connected, and the hydraulic fluid in the supplying-discharging fluid tube 81*a* passes through the output fluid tube 45 and the second control valve 56D and is discharged into the output fluid tube 46.

When the second control valve 56D is in the second position 91*b*, the input port 90*a* and the output port 90*b* are connected, and the hydraulic fluid of the second fluid tube 42 is supplied to the fourth fluid tube 44.

Figure 4B:
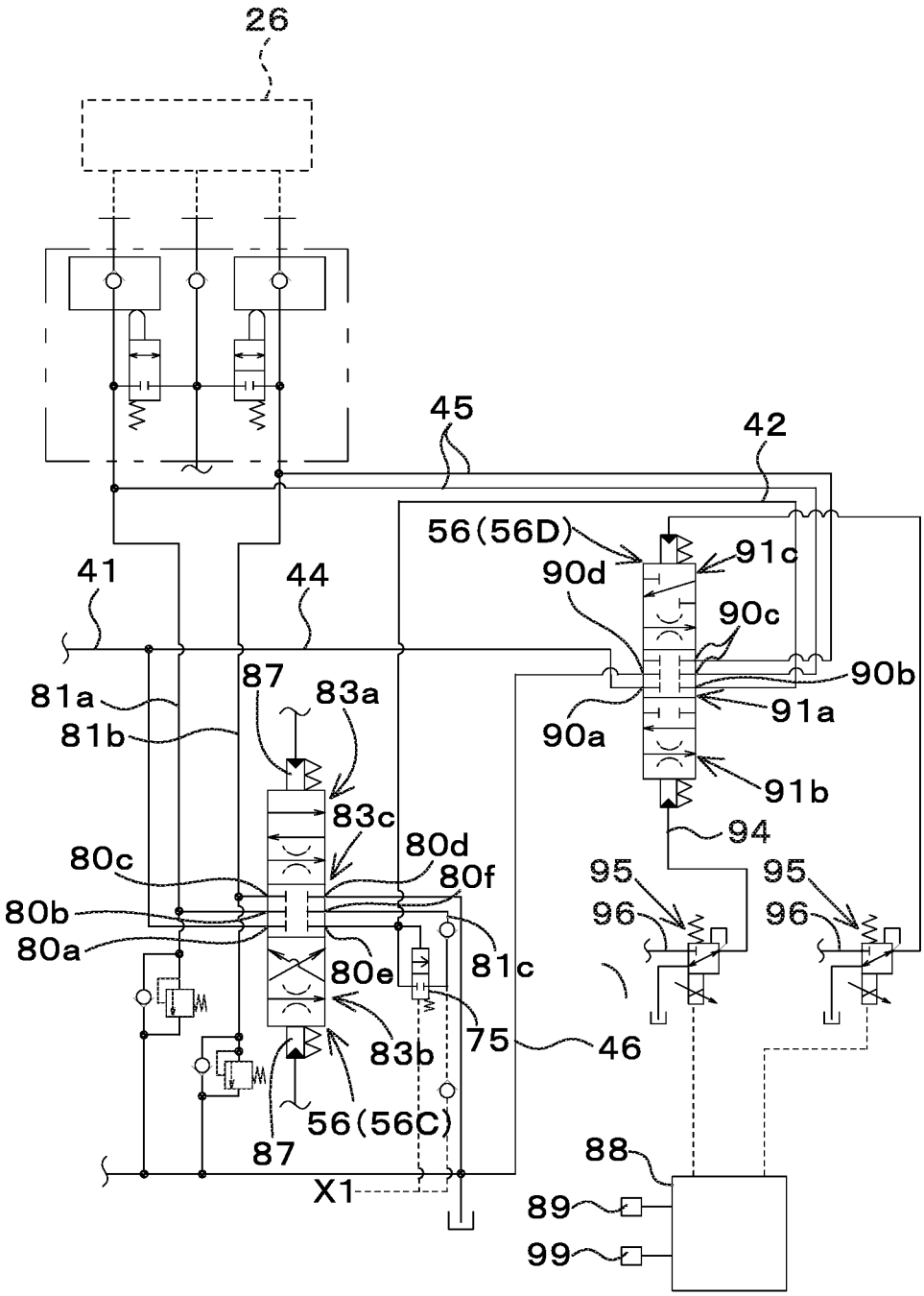
FIG. 4B is a view of a second modified example according to the embodiments.

FIG. 4B shows a second modified example of the hydraulic system of the working machine. The second modified example is a modified example of the second control valve 56D. In the second modified example, the second control valve 56D is a three-position switching valve having a first position 91*a*, a second position 91*b* and a third position 91*c*.

In the case of FIG. 4B, the two proportional valves 95 can be switched between the first position 91*a*, the second position 91*b* and the third position 93*c* by the two proportional valves 95.

Figure 4C:
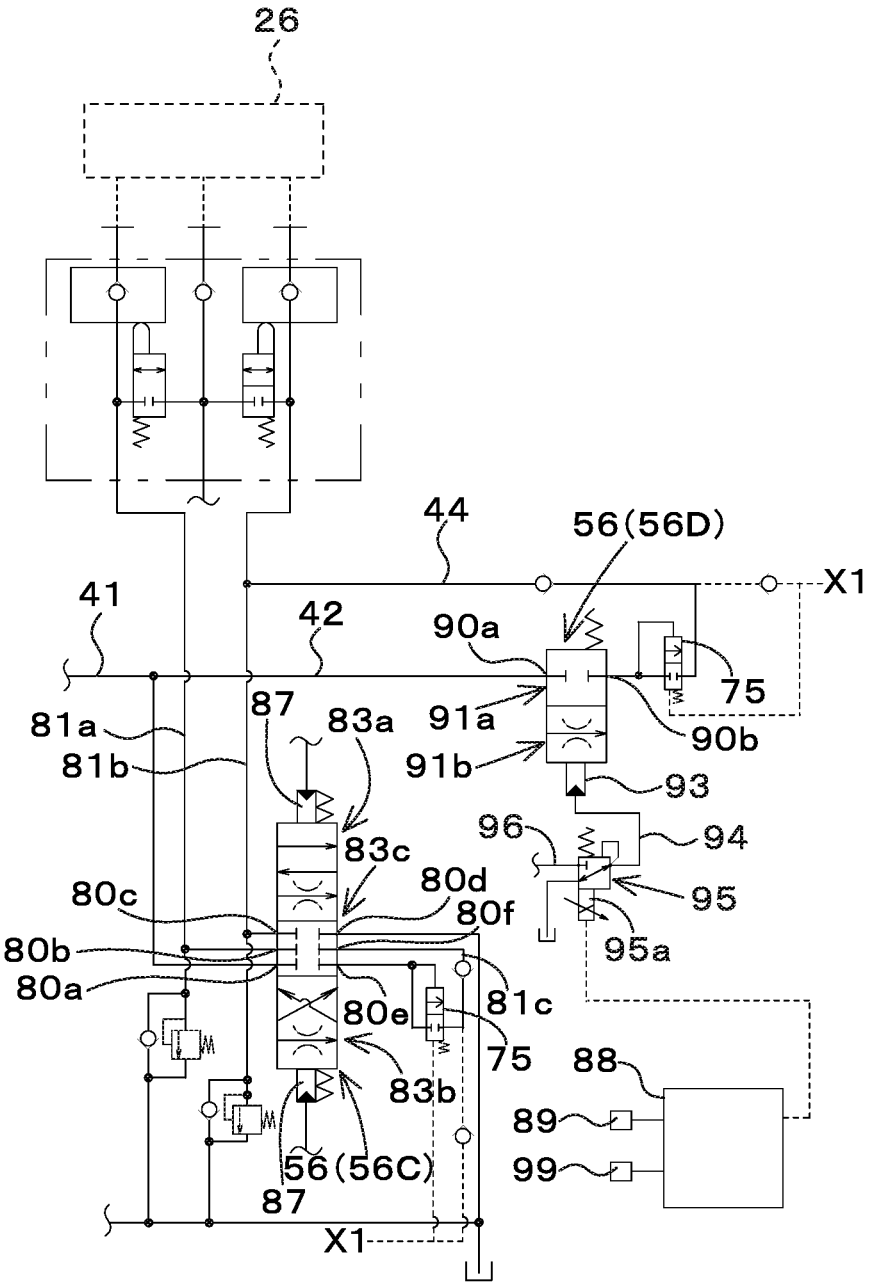
FIG. 4C is a view of a third modified example according to the embodiments.

FIG. 4C shows a third modified example of the hydraulic system for the working machine. The third modified example is a modified example of the connection target of the fourth fluid tube 44. The fourth fluid tube 44 connects the output port 90*b* of the second control valve 56D to the supplying-discharging fluid tube 81*b*.

When the second control valve 56D is in the second position 91*b*, the hydraulic fluid in the fourth fluid tube 44 is supplied (merged) into the supplying-discharging fluid tube 81*b* without passing through the first control valve 56C.

Figure 4D:
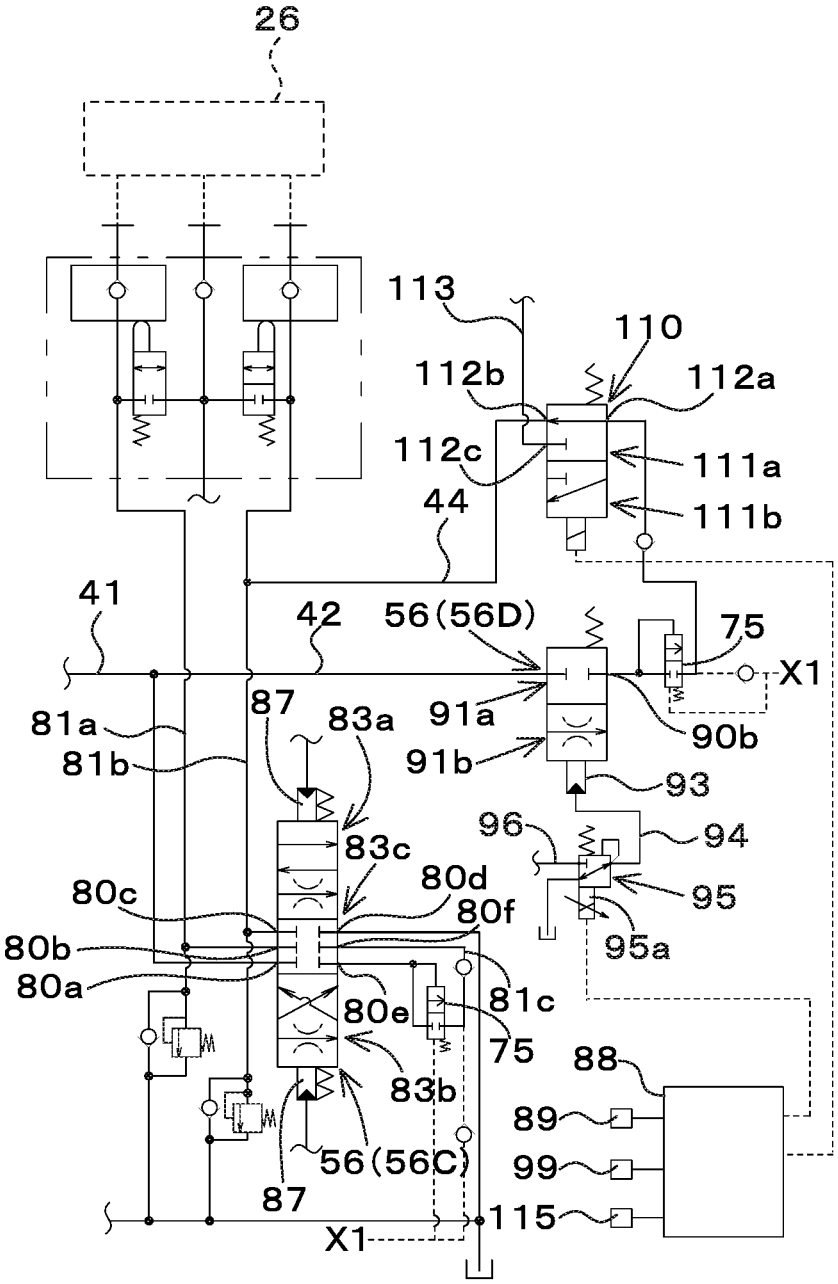
FIG. 4D is a view of a fourth modified example according to the embodiments.

FIG. 4D shows a fourth modified example of the hydraulic system for the working machine. The fourth modified example shows a modified example in which a directional switching valve 110 is connected to the middle portion of the fourth fluid tube 44. The directional switching valve 110 is an electronically-operated two-position switching valve of direct-acting spool-type that can be switched between a first position (a connecting position) 111*a* and a second position (a switching position) 111*b*.

The directional switching valve 110 has an input port 112*a* and output ports 112*b* and 112*c*. The input port 112*a* is connected to the input port 112*a* with a second fluid tube 42. The output port 112*b* is connected to the output port 112*b* with a supplying-draining fluid tube 81*b*. The output port 112*c* is connected to a fluid tube 113 to which another hydraulic actuator different from the hydraulic actuator 26 is connected.

The directional switching valve 110 is switchable by the controller device 88. The controller device 88 is connected to the controller device 88 with a switch 115 configured to be switched between ON or OFF. When the switch 115 is OFF, the controller device 88 demagnetizes the solenoid of the directional switching valve 110, and the directional switching valve 110 is held in the first position (the connecting position) 111*a*. When being in the first position (the connecting position) 111*a*, the hydraulic fluid passing through the output port 90*b* of the second control valve 56D flows from the fourth fluid tube 44 to the supplying-discharging fluid tube 81*b*.

When the switch 115 is ON, the controller 88 magnetizes the solenoid of the directional switching valve 110 and switches the directional switching valve 110 to the second position (the switching position) 111*b*. In the second position (the switching position) 111*b*, the hydraulic fluid that has passed through the output port 90*b* of the second control valve 56D flows from the fourth fluid tube 44 to the fluid tube 113.

In this manner, by switching the directional switching valve 110, the hydraulic fluid can be supplied to the supplying-discharging fluid tube 81*b* and the hydraulic fluid can flow into a fluid tube 113 separately from the supplying-discharging fluid tube 81*b*.

Figure 4E:
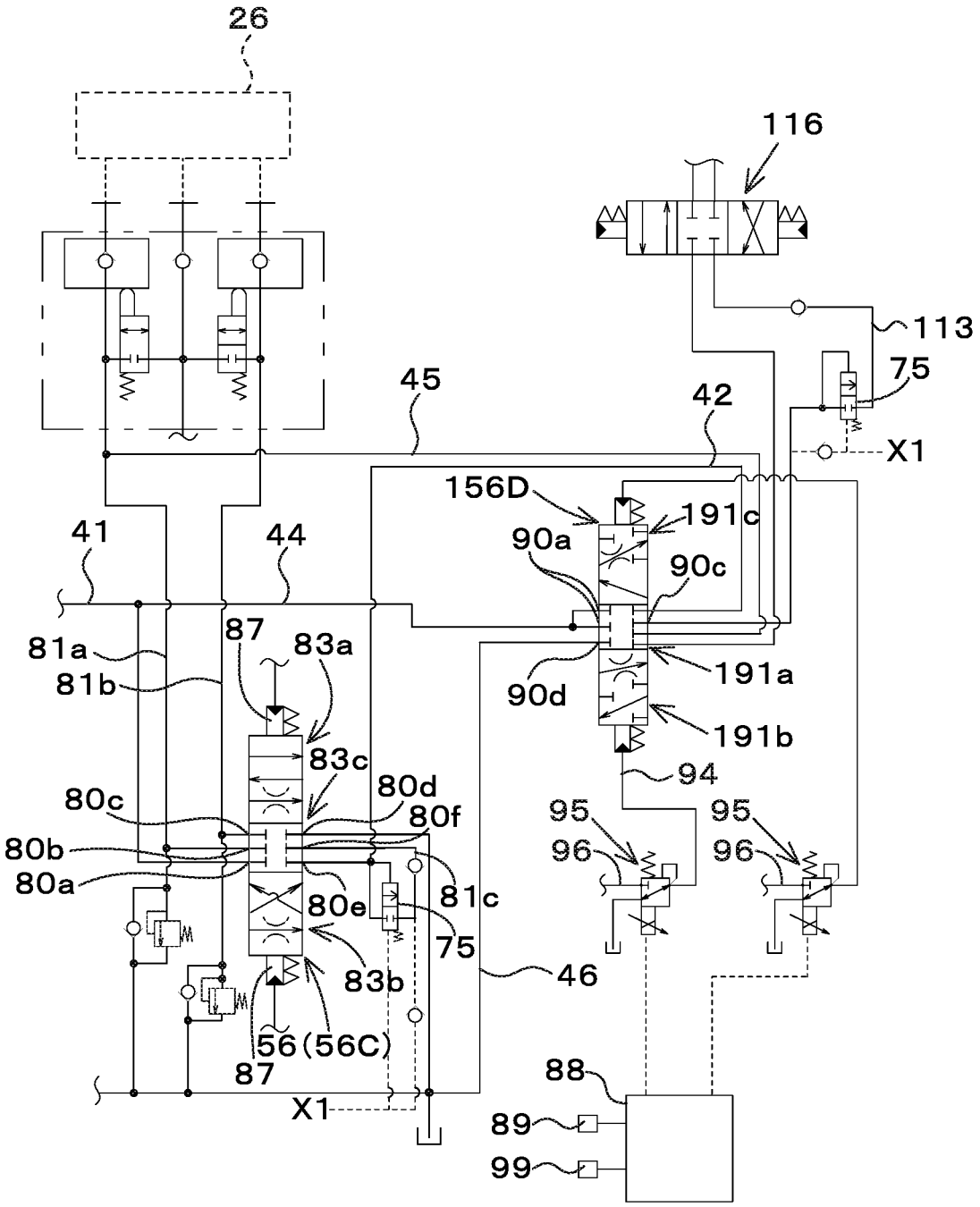
FIG. 4E is a view of a fifth modified example according to the embodiments.

FIG. 4E shows a fifth modified example of the hydraulic system for the working machine. The fifth modified example is an integrated valve 156D configured to integrate the second control valve 56D and the directional switching valve 110. The integrated valve 156D is a three-position switching valve.

The integrated valve 156D is switchable between a neutral position 191A, a connecting position 191B, which allows hydraulic fluid to flow to the second fluid tube 42 as in the second control valve 56D, and a switching position 191C, which allows hydraulic fluid to flow to the fluid tube 113. A control valve 116 is provided in the fluid tube 113 to control another hydraulic actuator.

When the amount of hydraulic fluid supplied to the third fluid tubes (81*a*, 81*b*, 81*c*) are increased, that is, in the increasing mode, the output (speed) of the cooling fan for cooling the radiator, fluid cooler, and the like may be changed.

For example, in the increasing mode, the number of revolutions of the cooling fan is set higher than in the normal mode, which is not the increasing mode, by control of the controller 88. Alternatively, the target temperature for cooling the radiator and fluid cooler is lower in the increasing mode than in the normal mode. Or, in the increasing mode, the time to increase the cooling fan speed (cooling time) is longer than in the normal mode.

The hydraulic system for the working machine includes the hydraulic pump P2, the hydraulic actuator 26, the first control valve 56C to which the hydraulic fluid outputted from the hydraulic pump P2 is supplied and which can control the hydraulic actuator 26, the second control valve 56D which can control the hydraulic actuator 26 separately from the first control valve 56C, the first fluid tube 41 connecting the hydraulic pump P2 and the first control valve 56C, the second fluid tube 42 branching from the first fluid tube 41 and connected to the input port 90*a* of the second control valve 56D, the third fluid tube (81*a*, 81*b*, 81*c*) connecting the first control valve 56C and the hydraulic actuator 26, and the fourth fluid tube 44 connected to the output port 90*b* of the second fluid tube 42 and connected to the third fluid tube (81*a*, 81*b*, 81*c*).

According to this configuration, by activating both the first control valve 56C and the second control valve 56D, the hydraulic fluid in the first fluid tube 41 can be supplied to the third fluid tube (81*a*, 81*b*, 81*c*) through the fourth fluid tube 44. This allows the flow rate of the hydraulic fluid to be easily controlled.

The second control valve 56D switches from the closing state to the opening state when an opening aperture of the first control valve 56C is a predetermined aperture or more. According to this configuration, the second control valve 56D transits to the opening state when the opening of the first control valve 56C is greater than or equal to the predetermined aperture. This allows the hydraulic fluid supplied to the third fluid tube (81A, 81B, 81C) to be gradually increased and the flow rate of the hydraulic fluid can be easily controlled.

The first control valve 56C is a switching valve having the neutral position to prevent the operation fluid from flowing to the third fluid tube (81*a*, 81*b*, 81*c*), and the supplying position to allow the operation fluid to flow to the third fluid tube (81*a*, 81*b*, 81*c*). The second control valve 56D switches from the closing state to the opening state when the first control valve 56C switches from the neutral position to the supplying position.

According to this configuration, after the first control valve 56C starts supplying the hydraulic fluid to the third fluid tube (81*a*, 81*b*, 81*c*), the second control valve 56D supplies the hydraulic fluid. From this point of view, the hydraulic fluid supplied to the third fluid tube (81*a*, 81*b*, 81*c*) can be gradually increased and the flow rate of the hydraulic fluid can be easily controlled.

The second control valve 56D gradually increases the opening aperture in the opening state. According to this configuration, the hydraulic fluid to be supplied to the third fluid tube (81*a*, 81*b*, 81*c*) can be gradually increased, and the hydraulic actuator 26 can be easily controlled.

The hydraulic system for the working machine includes the direction switching valve 110 connecting to an intermediate portion of the fourth fluid tube 44 and having: the connecting position allowing operation fluid passing through the output port 90*b* of the second control valve 56D to flow to the third fluid tube (81*a*, 81*b*, 81*c*); and the switching position allowing the operation fluid passing through the output port 90*b* to flow to another fluid tube.

According to this configuration, it is possible to supply the hydraulic fluid to another hydraulic actuator that is different from the hydraulic actuator 26, and possible to increase the amount of hydraulic fluid supplied to further another hydraulic actuator.

The hydraulic pump P2 is a variable displacement pump to vary a flow rate of the operation fluid. According to this configuration, when the hydraulic pump P2 is capable of changing the flow rate of the hydraulic fluid, the maximum openings (diameters) in at least two control valves (spools) of the first control valve 56C and the second control valve 56D allow the hydraulic actuator 26 to be supplied with as much hydraulic fluid as possible.

In the above description, the embodiment of the present invention has been explained. However, all the features of the embodiment disclosed in this application should be considered just as examples, and the embodiment does not restrict the present invention accordingly. A scope of the present invention is shown not in the above-described embodiment but in claims, and is intended to include all modifications within and equivalent to a scope of the claims.

What is claimed is:

1. A hydraulic system for a working machine comprising:
a hydraulic pump to output operation fluid;
a hydraulic actuator to be activated with the operation fluid;
a first control valve to which the operation fluid outputted by the hydraulic pump is supplied, the first control valve being configured to control the hydraulic actuator;
a second control valve to control the hydraulic actuator separately from the first control valve;
a first fluid tube connecting the hydraulic pump and the first control valve;
a second fluid tube branching from the first fluid tube and connecting to an input port of the second control valve;
a third fluid tube connecting the first control valve and the hydraulic actuator; and
a fourth fluid tube connecting to an output port of the second control valve and connecting to the third fluid tube,
wherein the second control valve switches from a closing state to an opening state when an opening aperture of the first control valve is a predetermined aperture or more, and
the second control valve gradually increases the opening aperture in the opening state.

2. The hydraulic system for the working machine according to claim 1, wherein
the first control valve is a switching valve having:
a neutral position to prevent operation fluid from flowing to the third fluid tube; and
a supplying position to allow the operation fluid to flow to the third fluid tube, and
the second control valve switches from the closing state to the opening state when the first control valve switches from the neutral position to the supplying position.

3. The hydraulic system for the working machine according to claim 2, comprising
a direction switching valve connecting to an intermediate portion of the fourth fluid tube and having:
a connecting position allowing operation fluid passing through the output port of the second control valve to flow to the third fluid tube; and
a switching position allowing the operation fluid passing through the output port to flow to another fluid tube.

4. The hydraulic system for the working machine according to claim 3, wherein
the hydraulic pump is a variable displacement pump to vary a flow rate of the operation fluid.

5. The hydraulic system for the working machine according to claim 2, wherein
the hydraulic pump is a variable displacement pump to vary a flow rate of the operation fluid.

6. The hydraulic system for the working machine according to claim 1, comprising
a direction switching valve connecting to an intermediate portion of the fourth fluid tube and having:
a connecting position allowing operation fluid passing through the output port of the second control valve to flow to the third fluid tube; and
a switching position allowing the operation fluid passing through the output port to flow to another fluid tube.

7. The hydraulic system for the working machine according to claim 1, wherein
the hydraulic pump is a variable displacement pump to vary a flow rate of the operation fluid.

8. A hydraulic system for a working machine comprising:
a hydraulic pump to output operation fluid;
a hydraulic actuator to be activated with the operation fluid;
a first control valve to which the operation fluid outputted by the hydraulic pump is supplied, the first control valve being configured to control the hydraulic actuator;
a second control valve to control the hydraulic actuator separately from the first control valve;
a first fluid tube connecting the hydraulic pump and the first control valve;
a second fluid tube branching from the first fluid tube and connecting to an input port of the second control valve;

a third fluid tube connecting the first control valve and the hydraulic actuator;

a fourth fluid tube connecting to an output port of the second control valve and connecting to the third fluid tube, and a direction switching valve connecting to an intermediate portion of the fourth fluid tube and having:

a connecting position allowing operation fluid passing through the output port of the second control valve to flow to the third fluid tube; and a switching position allowing the operation fluid passing through the output port to flow to another fluid tube.

9. The hydraulic system for the working machine according to claim 8, wherein the hydraulic pump is a variable displacement pump to vary a flow rate of the operation fluid.

10. A hydraulic system for a working machine comprising:

a hydraulic pump to output operation fluid;

a hydraulic actuator to be activated with the operation fluid;

a first control valve to which the operation fluid outputted by the hydraulic pump is supplied, the first control valve being configured to control the hydraulic actuator;

a second control valve to control the hydraulic actuator separately from the first control valve;

a first fluid tube connecting the hydraulic pump and the first control valve;

a second fluid tube branching from the first fluid tube and connecting to an input port of the second control valve;

a third fluid tube connecting the first control valve and the hydraulic actuator; and a fourth fluid tube connecting to an output port of the second control valve and connecting to the third fluid tube, wherein the second control valve switches from a closing state to an opening state when an opening aperture of the first control valve is a predetermined aperture or more, the hydraulic system further comprising a direction switching valve connecting to an intermediate portion of the fourth fluid tube and having:

a connecting position allowing operation fluid passing through the output port of the second control valve to flow to the third fluid tube; and a switching position allowing the operation fluid passing through the output port to flow to another fluid tube.

11. The hydraulic system for the working machine according to claim 10, wherein the hydraulic pump is a variable displacement pump to vary a flow rate of the operation fluid.

* * * * *